US007952288B2

(12) United States Patent
Nakazato

(10) Patent No.: US 7,952,288 B2
(45) Date of Patent: May 31, 2011

(54) POWER SUPPLY APPARATUS AND HIGH-FREQUENCY CIRCUIT SYSTEM

(75) Inventor: Yukihira Nakazato, Kanagawa (JP)

(73) Assignee: NEC Microwave Tube, Ltd., Kanagawa (JP)

( * ) Notice: Subject to any disclaimer, the term of this patent is extended or adjusted under 35 U.S.C. 154(b) by 431 days.

(21) Appl. No.: 12/249,572

(22) Filed: Oct. 10, 2008

(65) Prior Publication Data

US 2009/0096379 A1 Apr. 16, 2009

(30) Foreign Application Priority Data

Oct. 12, 2007 (JP) ..... 2007-266333

(51) Int. Cl.
*H01J 25/34* (2006.01)

(52) U.S. Cl. ..... 315/3.5; 315/3.6; 315/5

(58) Field of Classification Search ..... 315/10, 315/158, 30, 3.5, 3.6, 3.7, 500, 501, 506
See application file for complete search history.

(56) References Cited

U.S. PATENT DOCUMENTS 3,449,619 A * 6/1969 Stalp ..... 315/10
6,777,876 B2 * 8/2004 Kobayashi et al. ..... 315/3.5

FOREIGN PATENT DOCUMENTS

EP 1030341 A1 8/2000
EP 1517352 A2 3/2005
JP 1982186966 U 11/1982
JP 1986157251 U 9/1986
JP 199276240 U 7/1992
JP 1999149880 A 6/1999
JP 2005093229 A 4/2005

OTHER PUBLICATIONS

European Search Report for EP 08 01 7722 completed Mar. 10, 2010.*

M. Tsuneoka et al., "Design and Testing of Power Supplies for the High Power Gyrotron", Proceedings of the IEEE/NPSS Symposium Fusion Engineering, Sep. 30, 1991, pp. 497-500, XP010049337.

* cited by examiner

*Primary Examiner* — David Hung Vu

(57) ABSTRACT

The present invention includes a Zener diode connected between a helix electrode and an anode electrode, a transistor that closes or opens a circuit between a cathode and an anode of the Zener diode, a photocoupler for turning ON/OFF the transistor through a phototransistor, a first switch for supplying or cutting off a DC voltage for the photodiode of the photocoupler, a capacitor to which the DC voltage that is to be supplied to the photodiode is applied and a control unit that turns ON the first switch beforehand to apply a DC voltage to the photocoupler and the capacitor and that turns OFF the first switch simultaneously with an application of a helix voltage.

8 Claims, 8 Drawing Sheets

POWER SUPPLY APPARATUS AND HIGH-FREQUENCY CIRCUIT SYSTEM

This application is based upon and claims the benefit of priority from Japanese patent application No. 2007-266333, filed on Oct. 12, 2007, the disclosure of which is incorporated herein in its entirety by reference.

TECHNICAL FIELD

The present invention relates to a power supply apparatus and a high-frequency circuit system provided therewith suitable for use in supplying a predetermined DC voltage to each electrode provided for a traveling-wave tube.

BACKGROUND ART

Traveling-wave tubes or klystrons or the like are electron tubes used to perform amplification, oscillation or the like of a high-frequency signal through interaction between an electron beam emitted from an electron gun and a high-frequency circuit. As shown, for example, in FIG. 1, traveling-wave tube 1 is constructed of electron gun 10 that emits electron beam 50, helix electrode 20, which is a high-frequency circuit that causes electron beam 50 emitted from electron gun 10 to interact with a high-frequency signal (microwave), collector electrode 30 that captures electron beam 50 emitted from helix electrode 20 and anode electrode 40 that leads out electrons from electron gun 10 and guides electron beam 50 emitted from electron gun 10 into spiral helix electrode 20.

Electron gun 10 is provided with cathode electrode 11 that emits thermal electrons and heater 12 that gives thermal energy for emitting thermal electrons to cathode electrode 11.

Electron beam 50 emitted from electron gun 10 is accelerated by a potential difference between cathode electrode 11 and helix electrode 20, introduced into helix electrode 20 and travels through helix electrode 20 while interacting with a high-frequency signal inputted from one end of helix electrode 20. Electron beam 50 which has passed through helix electrode 20 is captured by collector electrode 30. In this case, a high-frequency signal which has been amplified by the interaction with electron beam 50 is outputted from the other end of helix electrode 20.

Power supply apparatus 60 supplies a helix voltage (H/K), which is a negative DC voltage, to cathode electrode 11 using a potential (HELIX) of helix electrode 20 as a reference and supplies a collector voltage (COL), which is a positive DC voltage, to collector electrode 30 using the potential (H/K) of cathode electrode 11 as a reference. Furthermore, power supply apparatus 60 supplies a heater voltage (H), which is a negative DC voltage, to heater 12 using the potential (H/K) of cathode electrode 11 as a reference. Helix electrode 20 is normally connected to a case of traveling-wave tube 1 and grounded.

FIG. 1 shows a configuration example of traveling-wave tube 1 provided with one collector electrode 30, but traveling-wave tube 1 may also have a configuration provided with a plurality of collector electrodes 30.

Furthermore, FIG. 1 shows the configuration of a high-frequency circuit system in which anode electrode 40 and helix electrode 20 are connected in power supply apparatus 60 and a ground potential is supplied to anode electrode 40, but a voltage different from the potential of helix electrode 20 may also be supplied to anode electrode 40 individually. In that case, an anode voltage (ANODE), which is a positive DC voltage, is supplied to anode electrode 40 using the potential (H/K) of cathode electrode 11 as a reference.

The helix voltage (H/K), collector voltage (COL) and heater voltage (H) are generated using, for example, a transformer, an inverter connected to a primary winding of the transformer that converts a DC voltage supplied from outside to an AC voltage and a rectification circuit that converts an AC voltage outputted from a secondary winding of the transformer to a DC voltage.

However, since electrons emitted from cathode electrode 11 due to a potential difference between anode electrode 40 and cathode electrode 11 in traveling-wave tube 1, it is desirable to reduce the potential difference between anode electrode 40 and cathode electrode 11 as much as possible when the supply voltage to each electrode is unstable as in the case of a rise (application) of helix voltage (H/K) or collector voltage (COL). When there is a potential difference between anode electrode 40 and cathode electrode 11 when the helix voltage (H/K) and collector voltage (COL) are applied, some of electrons emitted from cathode electrode 11 flow to the ground potential through helix electrode 20, and therefore an overcurrent flows through helix electrode 20, causing characteristic deterioration or damage of traveling-wave tube 1. Especially, in the configuration as shown in FIG. 1 in which anode electrode 40 is connected to helix electrode 20, a potential difference is produced between anode electrode 40 and cathode electrode 11 simultaneously with the application of the helix voltage (H/K), and therefore it is desirable to reduce this potential difference using some means.

To avoid such a problem, for example, Japanese Patent Laid-Open No. 2005-093229 (hereinafter referred to as "Patent Document 1") describes a configuration for controlling the supply and cutoff of an anode voltage through a circuit using an FET (Field Effect Transistor).

FIG. 2 is a block diagram showing a configuration of the high-frequency circuit system described in Patent Document 1.

As shown in FIG. 2, the high-frequency circuit system described in Patent Document 1 is provided with transistor Q1, a source of which is connected to a cathode electrode of traveling-wave tube 1, a drain of which is connected to an anode electrode and a helix electrode via resistor R1 of traveling-wave tube 1 and transistor Q2 for controlling ON/OFF of transistor Q1. An N-channel junction type FET is used for transistor Q1 and an N-channel MOSFET is used for transistor Q2.

The gate of transistor Q1 is connected to the drain of transistor Q2 and resistor R2 is connected in parallel between the gate and the source of transistor Q1. The source of transistor Q2 is connected to the heater of traveling-wave tube 1 and a voltage resulting from dividing the voltage between the helix electrode and the heater of traveling-wave tube 1, between resistors R3 and R4, is applied to the gate of transistor Q2.

In such a configuration, transistor Q1 turns ON and the potential of the anode electrode (A) substantially matches the helix voltage (H/K) for a period during which the helix voltage (H/K) and collector voltage (COL) are rising and when the helix voltage (H/K) and collector voltage (COL) rise to a certain degree, transistor Q1 turns OFF and the potential of the anode electrode (A) becomes substantially equal to the ground potential (HELIX). Timing at which transistor Q1 turns from ON to OFF is determined by the ratio of divided voltages of resistors R3 and R4 connected to the gate of transistor Q2.

In the high-frequency circuit system shown in FIG. 2, only a minimal current ($I_{HELIX}$) flows through the helix electrode of traveling-wave tube 1 when transistor Q1 turns from ON to OFF as shown in FIG. 3 making it possible to prevent any overcurrent from flowing through the helix electrode, thus causing characteristic deterioration or damage of traveling-wave tube 1. The anode voltage (ANODE) shown in FIG. 3 shows a potential difference from the helix voltage (H/K) and does not show an actual voltage variation.

Furthermore, other techniques for reducing a potential difference between the anode electrode and cathode electrode when the helix voltage (H/K) and collector voltage (COL) are applied include those described in Japanese Utility Model Laid-Open No. 57-186966, Japanese Utility Model Laid-Open No. 61-157251 and Japanese Utility Model Laid-Open No. 04-076240. These publications describe a configuration in which resistors R11 and R12 are connected in series between a helix electrode and a cathode electrode of traveling-wave tube 1, a helix voltage (H/K) is divided between resistors R11 and R12 and the resulting voltage is supplied to an anode electrode (A).

FIG. 4 is a block diagram showing a configuration of a high-frequency circuit system in which the voltage divided between resistors is supplied to the anode electrode.

In the configuration shown in FIG. 4, the potential difference between the anode electrode and the cathode electrode becomes smaller compared to the configuration shown in FIG. 1 in which the anode electrode is connected to the helix electrode, and it is thereby possible to reduce the current that flows through the helix electrode when the helix voltage (H/K) and collector voltage (COL) are applied.

However, according to the configuration shown in FIG. 2, in the above described power supply apparatuses, when transistor Q1 used to control the supply and cutoff of the anode voltage is OFF, that is, when traveling-wave tube 1 is operating normally, if a current flows through the anode electrode, a current also flows through resistor R1 connected between the helix electrode and the drain, which results in a problem in which the potential of the anode electrode decreases (approximates to the helix voltage (H/K)) and a maximum gain of traveling-wave tube 1 decreases.

For example, assuming that the current flowing through the anode electrode in the normal operation of traveling-wave tube 1 is 0.1 mA and that the value of resistor R1 is 10 MΩ, the potential of the anode electrode decreases by the order of 1 KV with respect to the potential of the helix electrode. When the value of resistor R1 is reduced, the potential difference between the anode electrode and the helix electrode in normal operation decreases. In such a case, however, the helix voltage (H/K) is applied when transistor Q1 is ON and power consumption of resistor R1 increases, and therefore the size of the package of resistor R1 increases.

Since the helix voltage (H/K) of traveling-wave tube 1 is generally several KV to several tens of KV, when, for example, the helix voltage (H/K) is 10 KV and the value of resistor R1 is 10 MΩ, power consumed by resistor R1 is 10 W. Reducing the value of resistor R1 causes the power consumed by resistor R1 to further increase and thereby further increases the size of the package of resistor R1.

Furthermore, according to the configuration shown in FIG. 2, since transistor Q1 used for supplying and cutting off the anode voltage operates at a high voltage using the helix voltage (H/K) as a reference, when it is desired to control ON/OFF of transistor Q1 using a logic circuit operating at a low voltage of, for example, several V instead of using transistor Q2, it is necessary to insulate the logic circuit from transistor Q1 using a high-pressure vacuum relay or the like. In such a case, the high-pressure vacuum relay is very expensive and the cost of the high-frequency circuit system increases.

On the other hand, the high-frequency circuit system shown in FIG. 4 can reduce the current that flows through the helix electrode when the helix voltage (H/K) and collector voltage (COL) are applied compared to the configuration in which the anode electrode of traveling-wave tube 1 shown in FIG. 1 is connected to the helix electrode as described above.

However, even in the configuration shown in FIG. 4, the potential difference between the anode electrode and cathode electrode increases as the helix voltage (H/K) increases, as shown in FIG. 5, and therefore a greater current ($I_{HELIX}$) flows through the helix electrode compared to the configuration shown in FIG. 2. The anode voltage (ANODE) shown in FIG. 5 shows a potential difference from the helix voltage (H/K) and does not show an actual voltage variation.

Furthermore, in the configuration shown in FIG. 4, a voltage closer to the helix voltage (H/K) than that in the configuration shown in FIG. 1 is applied to the anode electrode in normal operation, and therefore there is also a problem that the anode voltage drops in the normal operation of traveling-wave tube 1 in the same way as in the configuration shown in FIG. 2.

SUMMARY

It is therefore an object of the present invention to provide a power supply apparatus and a high-frequency circuit system provided therewith capable of reducing current flowing through a helix electrode when the helix voltage and the collector voltage rise and of preventing characteristic deterioration or damage of an electron tube such as a traveling-wave tube using low cost general-purpose parts without reducing the maximum gain in normal operation of the electron tube.

In order to achieve the above described object, an exemplary aspect of the invention is a power supply apparatus that supplies a predetermined DC voltage to an anode electrode, cathode electrode, helix electrode and collector electrode provided for an electron tube and includes a Zener diode connected between the helix electrode and the anode electrode for limiting a potential difference applied to the helix electrode and the anode electrode to within a Zener voltage, a photocoupler having a photodiode at an input end thereof and a phototransistor at an output end thereof for closing or opening a circuit between a cathode and an anode of the Zener diode, a first switch for supplying or cutting off a DC voltage for the photodiode, a capacitor to which the DC voltage that is to be supplied to the photodiode is applied, and a control unit that turns ON the first switch beforehand to apply a DC voltage to the photocoupler and the capacitor and turns OFF the first switch simultaneously with the application of a helix voltage that is to be supplied to the cathode electrode.

Alternatively, the power supply apparatus according to the present invention is a power supply apparatus that supplies a predetermined DC voltage to an anode electrode, cathode electrode, helix electrode and collector electrode provided for an electron tube and includes a Zener diode connected between the helix electrode and the anode electrode for limiting a potential difference applied to the helix electrode and the anode electrode to within a Zener voltage, a transistor that closes or opens a circuit between a cathode and an anode of the Zener diode, a photocoupler having a photodiode at an input end thereof and a phototransistor at an output end thereof for turning ON/OFF the transistor, a first switch for supplying or cutting off a DC voltage for the photodiode, a capacitor to which the DC voltage to be supplied to the photodiode is applied, and a control unit that turns ON the first switch beforehand, applies a DC voltage to the photocoupler and the capacitor and turns OFF the first switch simultaneously with an application of a helix voltage to be supplied to the cathode electrode.

On the other hand, the high-frequency circuit system according to the present invention includes the above described power supply apparatus and a traveling-wave tube in which a predetermined DC voltage is supplied from the power supply apparatus to the anode electrode, cathode electrode, helix electrode and collector electrode.

The above and other objects, features, and advantages of the present invention will become apparent from the following description with reference to the accompanying drawings, which illustrate examples of the present invention.

EXEMPLARY EMBODIMENT

Hereinafter, the present invention will be explained with reference to the accompanying drawings.

In the following explanation, a traveling-wave tube will be taken as an example of an electron tube provided for a high-frequency circuit system, but the power supply apparatus provided for the high-frequency circuit system of the present invention is also applicable to a power supply apparatus that supplies a predetermined DC voltage to each electrode of other electron tubes.

First Exemplary Embodiment

Figure 6:
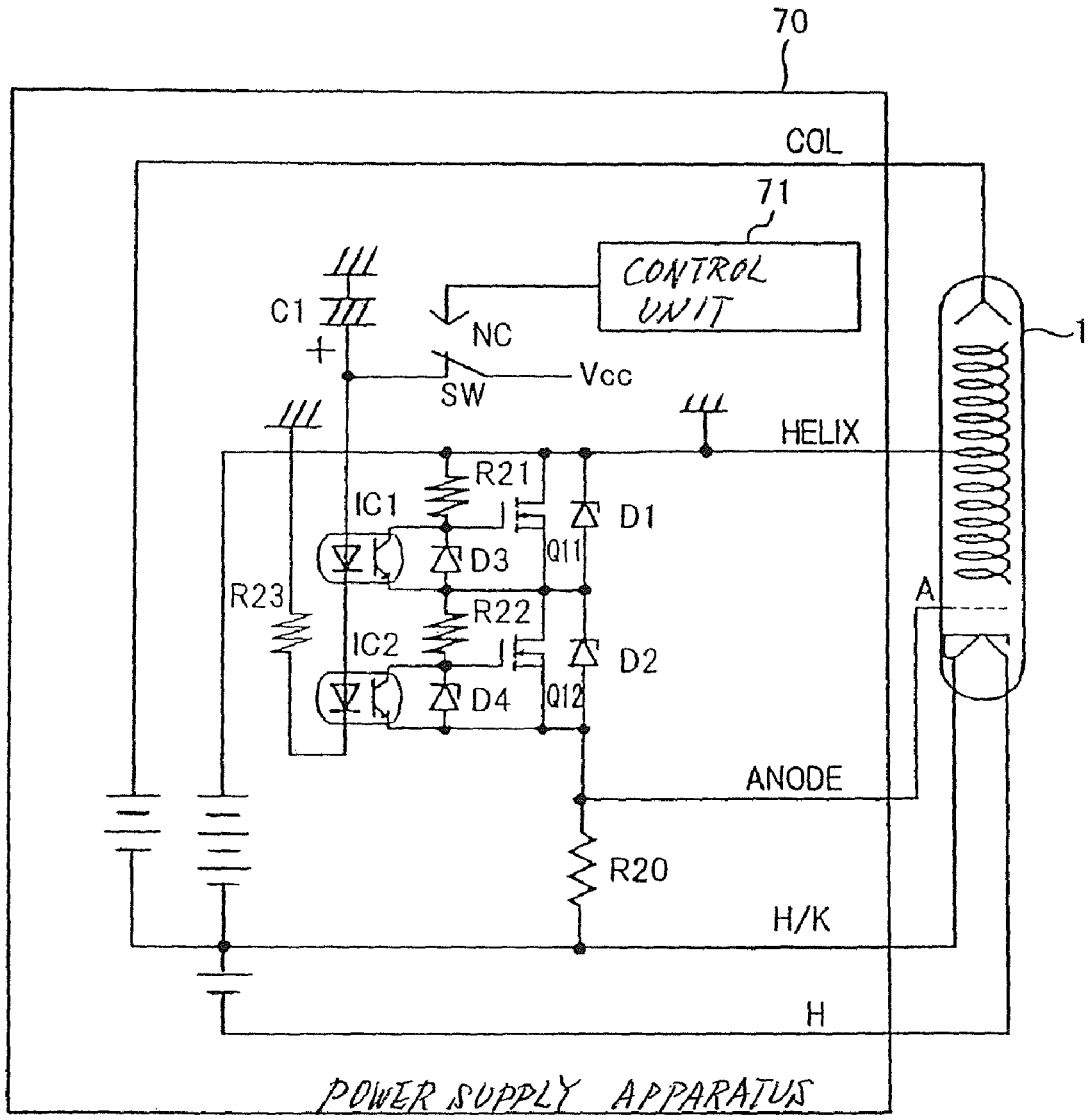
FIG. 6 is a block diagram showing a configuration of a high-frequency circuit system according to a first exemplary embodiment.

FIG. 6 is a block diagram showing a configuration of a high-frequency circuit system according to a first exemplary embodiment.

As shown in FIG. 6, the high-frequency circuit system of the first exemplary embodiment has a configuration including traveling-wave tube 1 and power supply apparatus 70 that supplies a predetermined DC voltage (supply voltage) to each electrode of traveling-wave tube 1.

Figure 1:
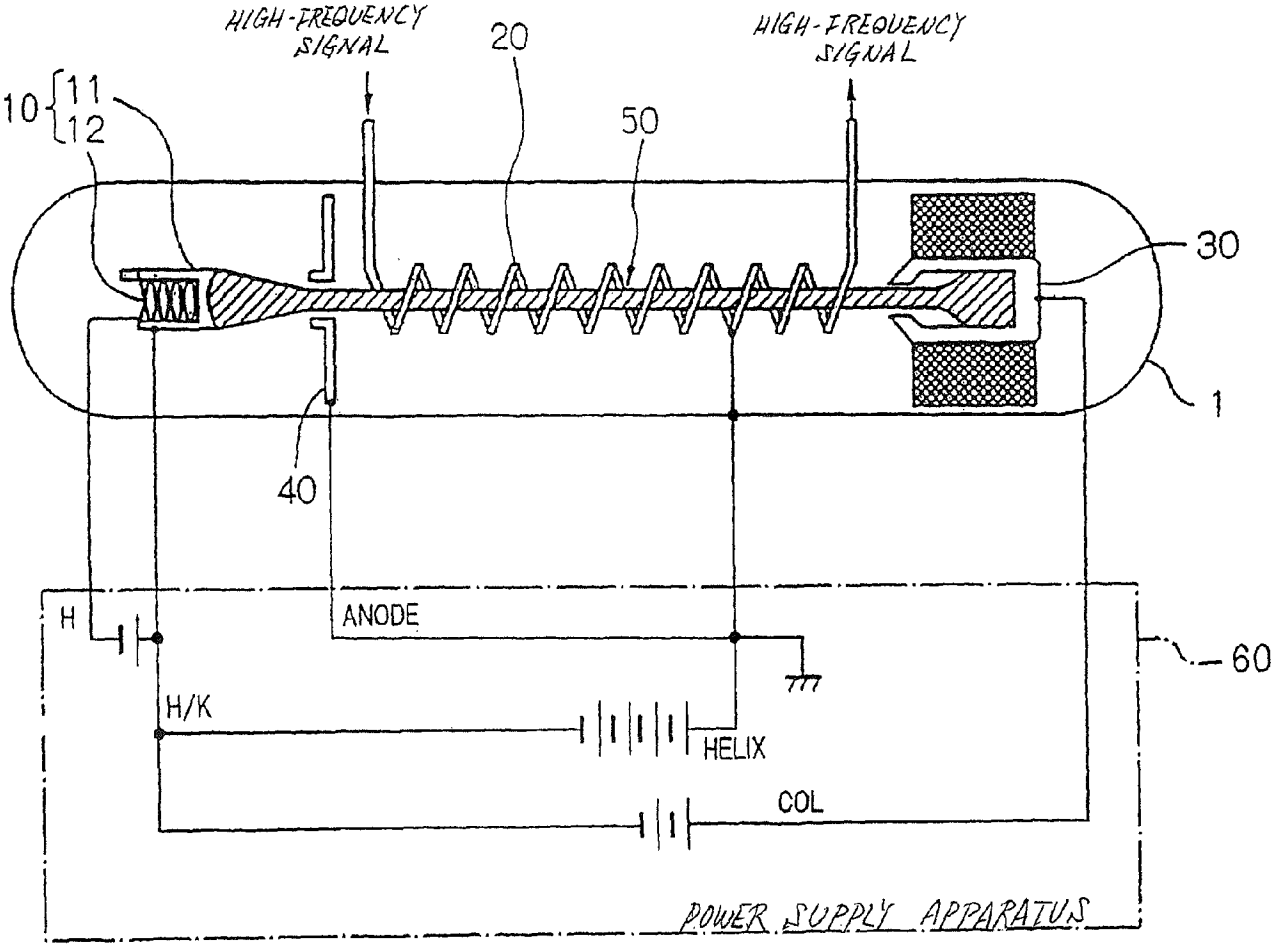
FIG. 1 is a block diagram showing a configuration of the related art of a high-frequency circuit system.
Figure 2:
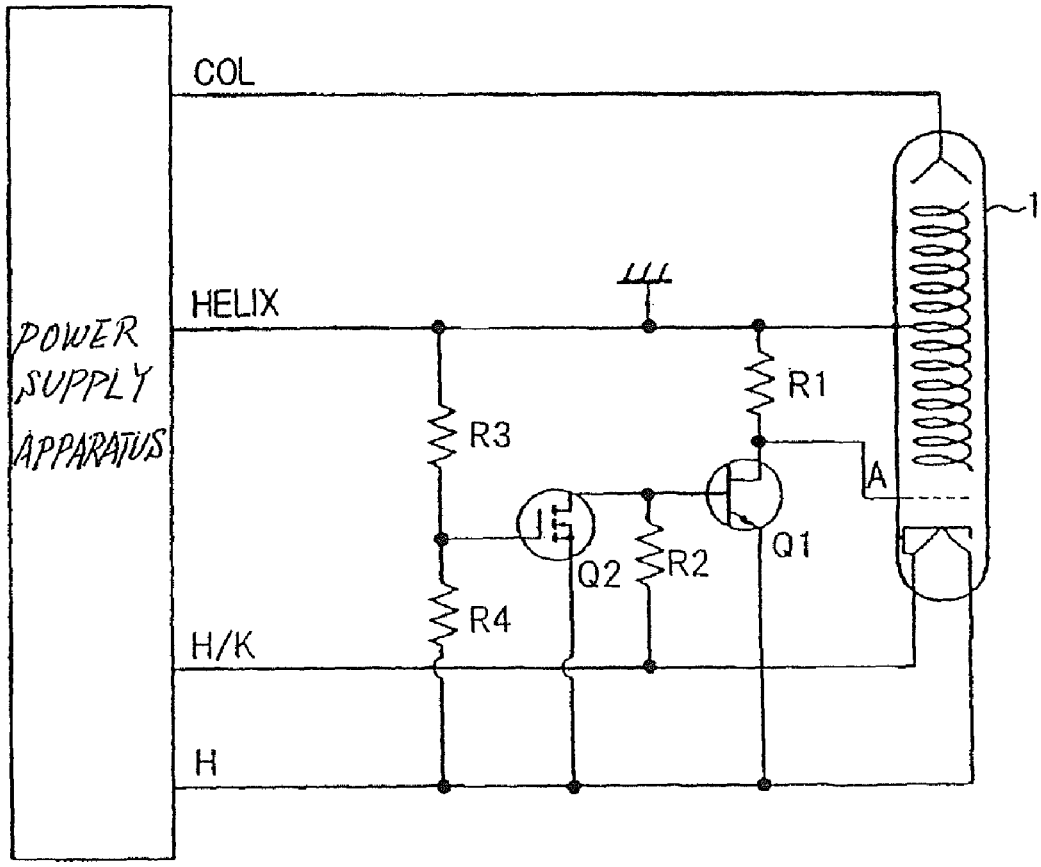
FIG. 2 is a block diagram showing a configuration of a high-frequency circuit system described in Patent Document 1.
Figure 3:
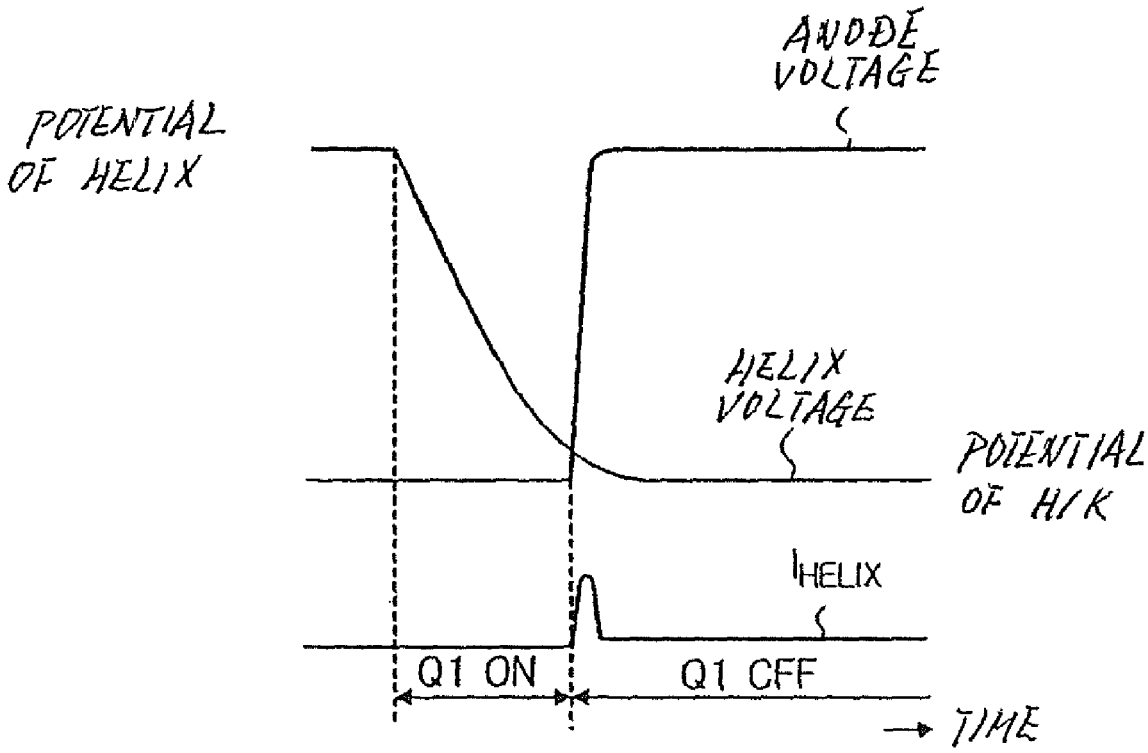
FIG. 3 is a schematic diagram showing a variation in the rise of a helix voltage, anode voltage and helix current of the high-frequency circuit system shown in FIG. 2.

Traveling-wave tube 1 shown in FIG. 6 has a configuration similar to that of traveling-wave tube 1 shown in FIG. 1, and therefore explanations thereof will be omitted.

Power supply apparatus 70 has a configuration including Zener diodes D1, D2 connected in series between a helix electrode and an anode electrode (A) for limiting a potential difference applied to the helix electrode and the anode electrode of traveling-wave tube 1 to within a Zener voltage, resistor R20 inserted between the cathode electrode and the anode electrode (A) of traveling-wave tube 1, transistors Q11, Q12 connected parallel to Zener diodes D1, D2 for closing or opening the circuit between the cathodes and anodes of Zener diodes D1, D2, photocouplers IC1, IC2 having a photodiode provided at an input end thereof connected in series and a phototransistor provided at an output end thereof for turning ON/OFF transistors Q11, Q12, Zener diodes D3, D4 and resistors R21, R22 connected between the outputs of photocouplers IC1, IC2 and the gates of transistors Q11, Q12, resistor R23 connected in series to the input ends of photocouplers IC1, IC2, a switch (first switch) SW for supplying or cutting off DC voltage Vcc to the photodiodes provided for photocouplers IC1, IC2, capacitor C1 to which DC voltage Vcc that is to be supplied to the photodiodes provided for photocouplers IC1, IC2 is applied, and control unit 71 that controls the operation of switch SW. A required supply voltage is supplied to control unit 71 from a power supply source (not shown). Furthermore, DC voltage Vcc is also supplied from a voltage source (not shown).

Zener diodes D1, D2 are connected in series by connecting the anode of Zener diode D1 to the cathode of Zener diode D2, the cathode of Zener diode D1 is connected to the helix electrode of traveling-wave tube 1 and the anode of Zener diode D2 is connected to the anode electrode (A) of the traveling-wave tube.

For transistors Q11, Q12, for example, an N-channel MOSFET as shown in FIG. 6 is used. The drain of transistor Q11 is connected to the cathode of Zener diode D1 and the source is connected to the anode of Zener diode D1. Furthermore, the drain of transistor Q12 is connected to the cathode of Zener diode D2 and the source is connected to the anode of Zener diode D2.

Resistor R21 is connected in parallel between the gate and drain of transistor Q11, and Zener diode D3 is connected in parallel between the gate and source of transistor Q11. Furthermore, resistor R22 is connected in parallel between the gate and drain of transistor Q12, and Zener diode D4 is connected in parallel between the gate and source of transistor Q12.

Photocouplers IC1, IC2 are each provided with a photodiode at an input end thereof and a phototransistor at an output end thereof that turns ON/OFF depending on whether light is emitted or not. The input ends of photocouplers IC1, IC2 and resistor R23 are connected in series. As for photocouplers IC1, IC2, when DC voltage Vcc is applied to the input end, a current flows through the photodiode, which causes the photodiode to emit light, and light emission by the photodiode causes the phototransistor at the output end to turn ON. When no current flows through the photodiode, light emission stops and the phototransistor thereby turns OFF.

Control unit 71 causes switch SW to turn ON beforehand to apply DC voltage Vcc to the photodiodes of photocouplers IC1, IC2 and capacitor C1, and causes switch SW to turn OFF simultaneously with applications of the helix voltage (H/K) and collector voltage (COL). In this case, DC voltage Vcc supplied to the photodiodes drops at a time constant determined by the values of capacitor C1 and resistor R23. Control unit 71 can be realized by combining a driver circuit for driving switch SW, a CPU or a DSP that operates according to a program or according to various logic circuits.

FIG. 6 shows the configuration example where two Zener diodes D1, D2 are connected in series between the helix electrode and anode electrode (A) of traveling-wave tube 1, but the number of Zener diodes is not limited to 2 and may be one or three or more. In such a case, transistors and photocouplers or the like may be connected to the respective Zener diodes connected in series between the helix electrode and the anode electrode (A) in the same way as in the circuit shown in FIG. 6.

Furthermore, FIG. 6 shows the configuration using N-channel MOSFETs as transistors Q11, Q12, but transistors Q11, Q12 can also be configured using P-channel transistors.

Furthermore, FIG. 6 shows the configuration example where transistors Q11, Q12 are connected in parallel to Zener diodes D1, D2, but transistors Q11, Q12 and resistors R21, R22 and Zener diodes D3, D4 connected to their gates need not necessarily be provided. In such a case, the phototransistors provided at the output ends of photocouplers IC1, IC2 may be connected in parallel to Zener diodes D1, D2. Transistors Q11, Q12 shown in FIG. 6 are provided to close or open the circuit between the cathode and anode of Zener diodes D1, D2 even when the Zener voltages of Zener diodes D1, D2 are high. Therefore, if the withstand voltages of the phototransistors provided for photocouplers IC1, IC2 are sufficiently higher than the Zener voltages of Zener diodes D1, D2, it is also possible to close or open the circuit between the cathode and anode of Zener diodes D1, D2 using photocouplers IC1, IC2.

Next, the operation of power supply apparatus 70 according to the present exemplary embodiment will be explained with reference to the accompanying drawings.

Figure 7:
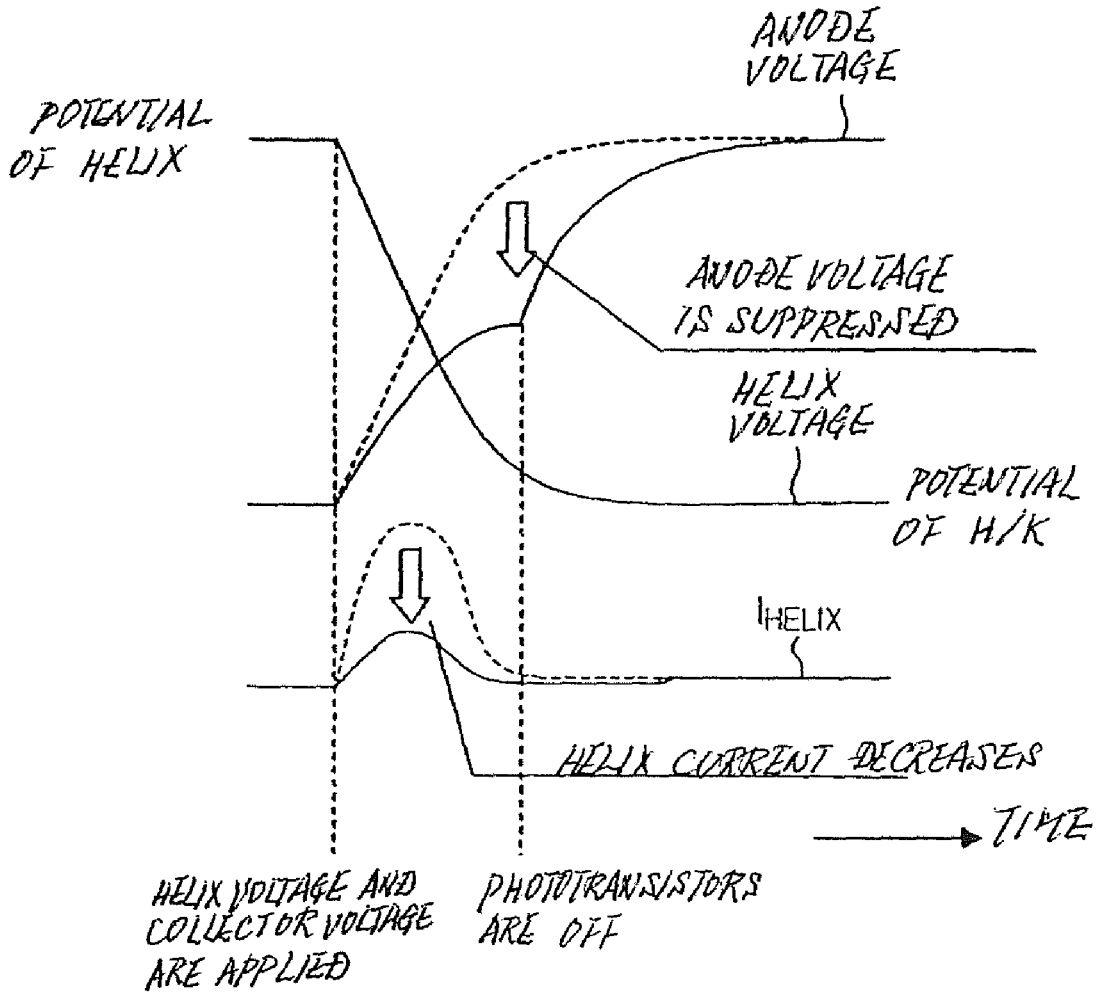
FIG. 7 is a schematic diagram showing a variation in the rise of a helix voltage, anode voltage and helix current of the power supply apparatus according to the first exemplary embodiment.

FIG. 7 is a schematic diagram showing a variation in the rise of the helix voltage, anode voltage and helix current of the power supply apparatus according to the first exemplary embodiment. The anode voltage (ANODE) shown in FIG. 7 shows a potential difference from the helix voltage (H/K) and does not show the actual voltage variation.

As described above, control unit 71 turns ON switch SW beforehand and applies DC voltage Vcc to the photodiodes provided for photocouplers IC1, IC2 and capacitor C1. In this condition, currents flow through the photodiodes provided for photocouplers IC1, IC2 and the respective phototransistors are ON, and therefore transistors Q11, Q12 turn OFF and the circuit between the cathode and anode of Zener diodes D1, D2 is opened.

When the helix voltage (H/K) and collector voltage (COL) are applied, control unit 71 turns OFF switch SW. However, since the charge stored in capacitor C1 is supplied to the photodiodes of photocouplers IC1, IC2 immediately after switch SW is turned OFF, the circuit between the cathode and anode of Zener diodes D1, D2 is left open. Therefore, in the beginning of the rise of the helix voltage (H/K) and collector voltage (COL), the potential difference between the helix electrode and anode electrode is limited to within the Zener voltage of Zener diodes D1, D2 (Zener voltage of D1 $V_{Z1}$+ Zener voltage D2 $V_{Z2}$). Therefore, the anode voltage is suppressed in rise of the helix voltage (H/K) and collector voltage (COL) and the current flowing through the helix electrode ($I_{HELIX}$) decreases.

When the charge stored in capacitor C1 is discharged, the current flowing through the photodiodes of photocouplers IC1, IC2 decreases and the photodiodes stop light emission and the phototransistors turn OFF. In this case, since transistors Q11, Q12 turn ON, the cathodes and anodes of Zener diodes D1, D2 are short-circuited by transistors Q11, Q12. As a result, the potential of the anode electrode (A) becomes a voltage to which the ON voltage of transistors Q11, Q12 decreases from the ground potential (HELIX).

Figure 4:
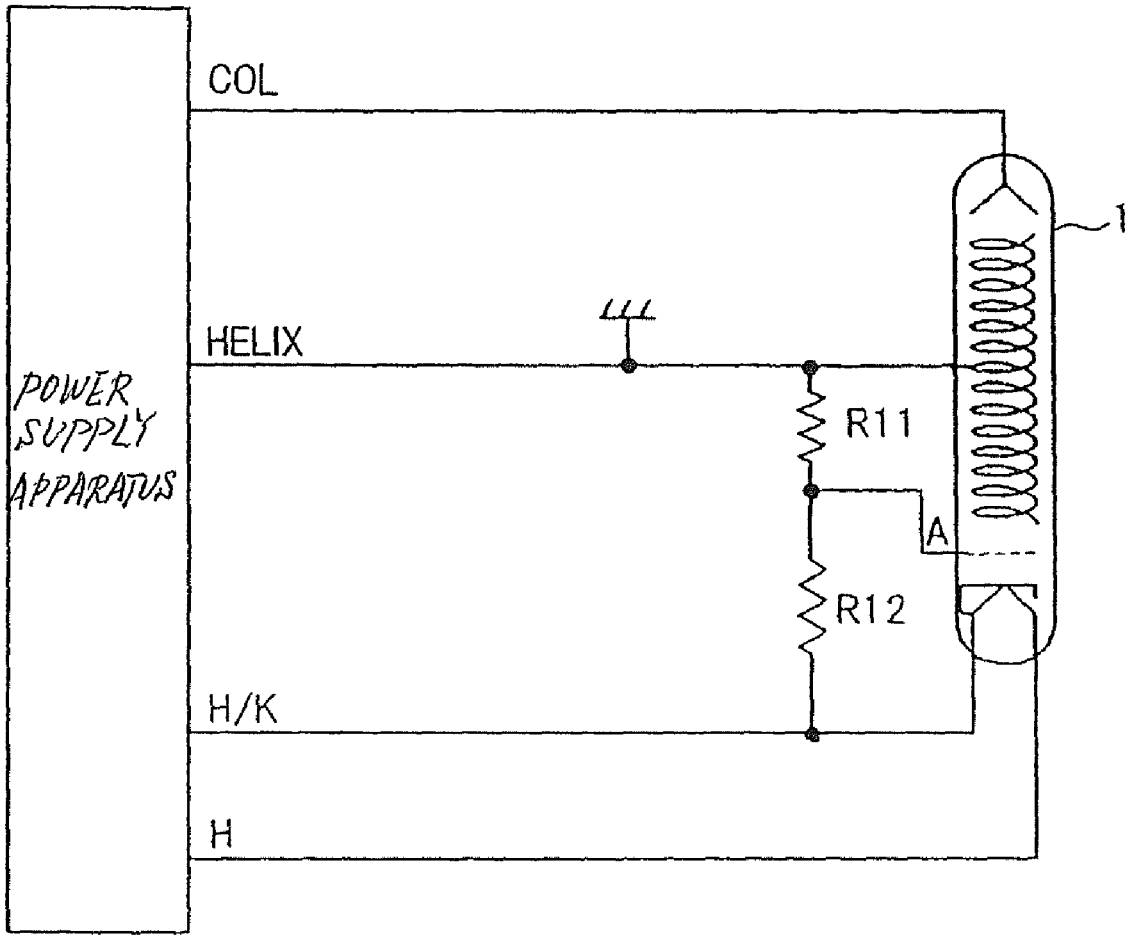
FIG. 4 is a block diagram showing a configuration of a high-frequency circuit system that supplies a voltage divided by resistors to an anode electrode.
Figure 5:
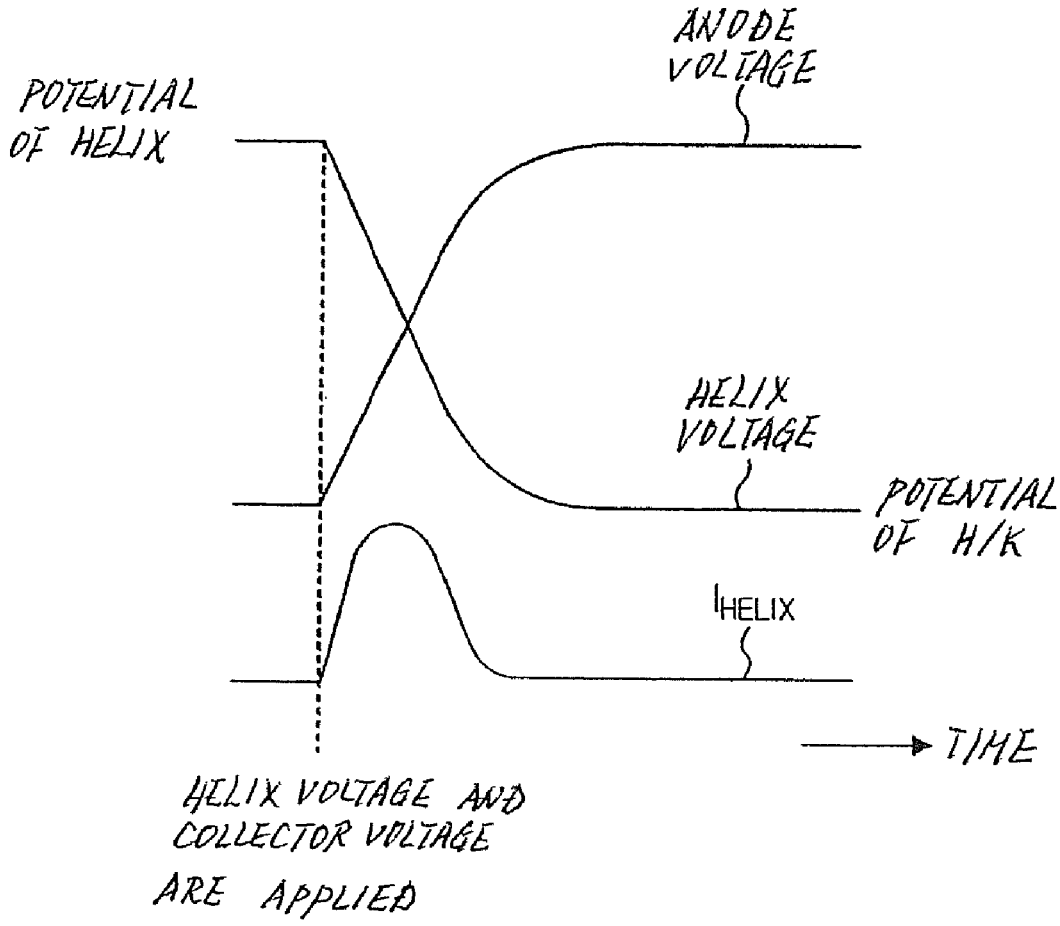
FIG. 5 is a schematic diagram showing a variation in the rise of a helix voltage, anode voltage and helix current of the high-frequency circuit system shown in FIG. 4.

According to power supply apparatus 70 of the present exemplary embodiment, since the potential difference between the helix voltage (H/K) and anode voltage is limited by Zener diodes D1, D2 connected between the helix electrode and anode electrode, when the helix voltage (H/K) and collector voltage (COL) are first applied, it is possible to reduce the current ($I_{HELIX}$) that flows through the helix electrode in the rise of the helix voltage (H/K) and collector voltage (COL) compared to the configuration shown in FIG. 4. Therefore, characteristic deterioration or damage of traveling-wave tube 1 can be prevented. Furthermore, because the current flowing through the helix electrode of traveling-wave tube 1 decreases, the load of power supply apparatus 70 decreases when the helix voltage (H/K) and collector voltage (COL) are applied.

Furthermore, after the helix voltage (H/K) and collector voltage (COL) have risen, the cathodes and anodes of Zener diodes D1, D2 are short-circuited by transistors Q11, Q12 respectively, and therefore the potential of the anode electrode becomes substantially equal to the potential of the helix electrode. This suppresses the reduction of the anode voltage in normal operation of traveling-wave tube 1.

Furthermore, the power supply apparatus of the present exemplary embodiment controls the anode voltage using Zener diodes D1, D2, transistors Q11, Q12 and photocouplers IC1, IC2 or the like connected to the helix electrode of traveling-wave tube 1, which is at the ground potential, and can thereby control the potential difference between the helix voltage (H/K) and anode voltage even when, for example, control unit 71 is made up of a logic circuit or the like, which operates at a low voltage on the order of several V. This eliminates the necessity for using an expensive high-pressure vacuum relay or the like and makes it possible to reduce the current ($I_{HELIX}$) that flows through the helix electrode in the rise of the helix voltage (H/K) and collector voltage (COL) using low-cost general-purpose parts.

Second Exemplary Embodiment

Figure 8:
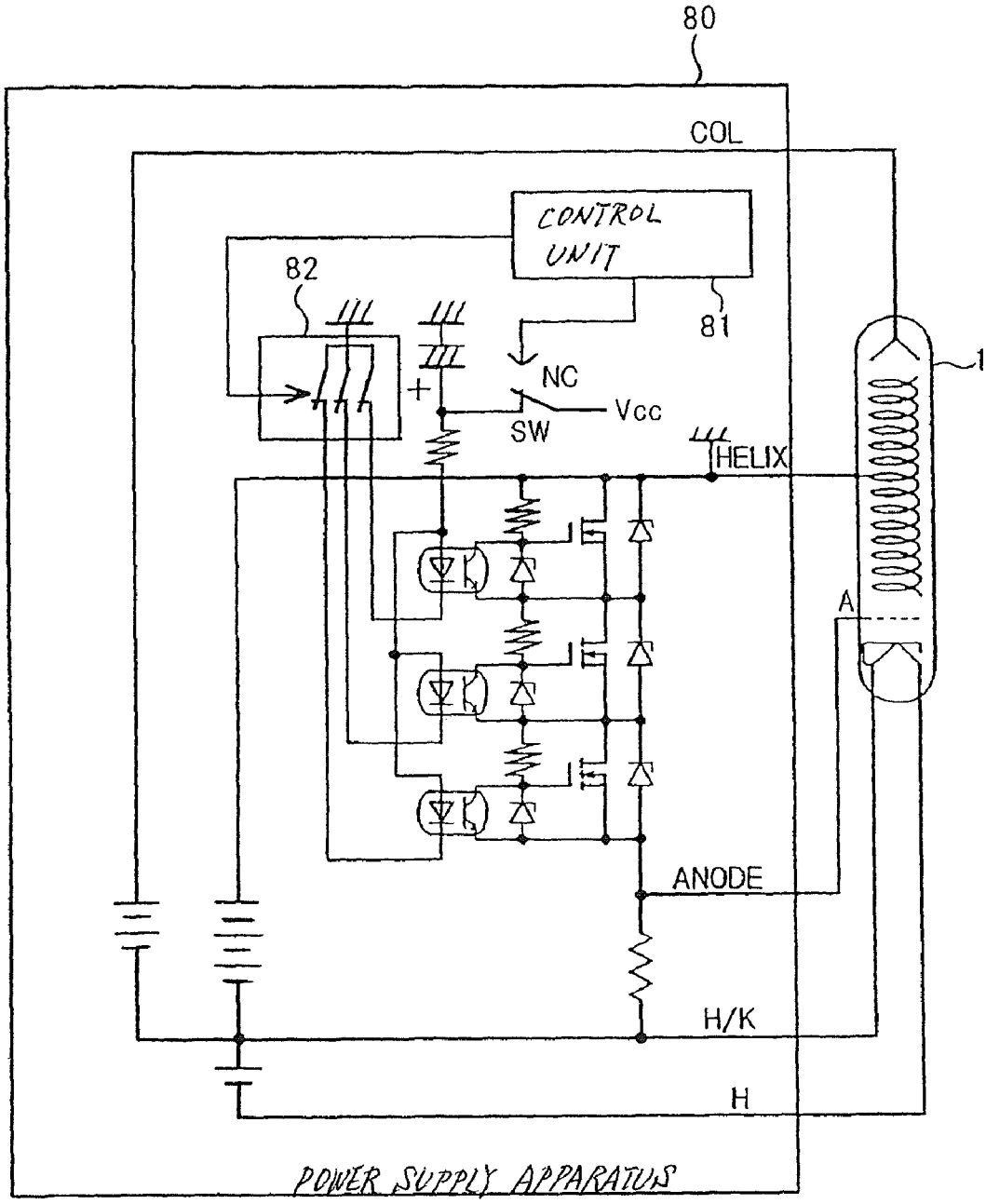
FIG. 8 is a block diagram showing a configuration of a high-frequency circuit system according to a second exemplary embodiment.

FIG. 8 is a block diagram showing a configuration of a high-frequency circuit system according to a second exemplary embodiment.

As shown in FIG. 8, power supply apparatus 80 of the second exemplary embodiment has a configuration provided with switch circuit 82 for individually controlling ON/OFF of a plurality of photocouplers in addition to the power supply apparatus shown in FIG. 6. Switch circuit 82 is provided with a plurality of switches (second switches) and individually closes or opens the circuit between the cathode of each photodiode and ground potential provided for each photocoupler.

In the photocoupler in which the cathode of the photodiode is connected with the ground potential by switch circuit 82, the phototransistor turns ON and the corresponding transistor thereby turns OFF and the circuit between the cathode and anode of the Zener diode connected in parallel is opened. On the other hand, in the photocoupler in which the cathode of the photodiode is disconnected from the ground potential by the switch circuit, the phototransistor turns OFF and the corresponding transistor thereby turns ON and the cathode and anode of the Zener diode connected in parallel are short-circuited.

Control unit 81 according to the present exemplary embodiment controls ON/OFF of switch (first switch) SW and also controls ON/OFF of each switch (second switch) provided for switch circuit 82. Since the rest of the configuration is similar to that of the first exemplary embodiment, explanations thereof will be omitted.

FIG. 8 shows a configuration example where three Zener diodes are connected in series between the helix electrode and the anode electrode (A) of traveling-wave tube 1, but the number of Zener diodes is not limited to three and any number of Zener diodes may also be used. In such a case, transistors, photocouplers, switch circuit 82 or the like may be connected to the respective Zener diodes connected in series between the helix electrode and anode electrode (A) in the same way as in the circuit shown in FIG. 8.

In power supply apparatus 80 of the present exemplary embodiment, switch circuit 82 can select a Zener diode that limits the potential difference between the helix voltage (H/K) and anode voltage when the helix voltage (H/K) and collector voltage (COL) are applied. That is, it is possible to limit the potential difference applied to the helix electrode and anode electrode of traveling-wave tube 1 to within a Zener voltage of the desired Zener diode. Therefore, it is possible to optimally suppress current flowing through the helix electrode when the helix voltage (H/K) and collector voltage (COL) are applied according to the characteristic and the operating condition of traveling-wave tube 1 connected to power supply apparatus 80.

Furthermore, power supply apparatus 80 of the present exemplary embodiment can not only suppress current flowing through the helix electrode using switch circuit 82 when the helix voltage (H/K) and collector voltage (COL) are applied but can also set the anode voltage of traveling-wave tube 1 in normal operation to a desired fixed value (however, the anode voltage is a voltage equal to or lower than the helix voltage). That is, always keeping the desired switch SW provided for switch circuit 82 ON allows the potential difference applied between the helix electrode and the anode electrode in normal operation of traveling-wave tube 1 to match the Zener voltage of the desired Zener diode. In such a case, the operation gain of traveling-wave tube 1 can be adjusted using switch circuit 82.

While the invention has been particularly shown and described with reference to exemplary embodiments thereof, the invention is not limited to these exemplary embodiments. It will be understood by those ordinarily skilled in the art that various changes in form and details may be made therein without departing from the spirit and scope of the present invention as defined by the claims.

What is claimed is:

1. A power supply apparatus that supplies a predetermined DC voltage to an anode electrode, cathode electrode, helix electrode and collector electrode provided for an electron tube, comprising:

a Zener diode connected between said helix electrode and said anode electrode for limiting a potential difference applied to said helix electrode and said anode electrode to within a Zener voltage;

a photocoupler having a photodiode at an input end thereof and a phototransistor at an output end thereof for closing or opening a circuit between a cathode and an anode of said Zener diode;

a first switch for supplying or cutting off a DC voltage for said photodiode;

a capacitor to which said DC voltage that is to be supplied to said photodiode is applied; and a control unit that turns ON said first switch beforehand to apply a DC voltage to said photocoupler and said capacitor and turns OFF said first switch simultaneously with the application of a helix voltage that is to be supplied to said cathode electrode.

2. A power supply apparatus that supplies a predetermined DC voltage to an anode electrode, cathode electrode, helix electrode and collector electrode provided for an electron tube, comprising:

a Zener diode connected between said helix electrode and said anode electrode for limiting a potential difference applied to said helix electrode and said anode electrode to within a Zener voltage;

a transistor that closes or opens a circuit between a cathode and an anode of said Zener diode;

a photocoupler having a photodiode at an input end thereof and a phototransistor at an output end thereof for turning ON/OFF said transistor;

a first switch for supplying or cutting off a DC voltage for said photodiode;

a capacitor to which the DC voltage that is to be supplied to said photodiode is applied; and a control unit that turns ON said first switch beforehand to apply a DC voltage to said photocoupler and said capacitor and turns OFF said first switch simultaneously with an application of a helix voltage that is to be supplied to said cathode electrode.

3. The power supply apparatus according to claim 1, further comprising a switch circuit comprising the plurality of Zener diodes connected in series between said helix electrode and said anode electrode, a plurality of photocouplers to which said photodiode is connected in series for closing or opening the circuit between the cathode and anode of said Zener diode using the phototransistor and a plurality of second switches for individually connecting or disconnecting the cathode of said photodiode and ground potential, wherein said control unit turns ON or OFF said second switch so that a potential difference applied between said helix electrode and said anode electrode is limited to within a Zener voltage of the desired Zener diode.

4. The power supply apparatus according to claim 2, further comprising a switch circuit comprising the plurality of Zener diodes connected in series between said helix electrode and said anode electrode, a plurality of transistors that close or open the circuit between the cathode and anode of said Zener diode, a plurality of photocouplers to which said photodiode is connected in series for turning ON/OFF the transistor using said phototransistor and a plurality of second switches for individually connecting or disconnecting the cathode of said photodiode and ground potential, wherein the control unit turns ON or OFF the second switch so that a potential difference applied to said helix electrode and said anode electrode is limited to within a Zener voltage of the desired Zener diode.

5. The power supply apparatus according to claim 3, wherein said control unit keeps ON said first switch even after said helix voltage is applied and turns ON or OFF said second switch so that a potential difference applied between said helix electrode and said anode electrode in normal operation of said electron tube becomes the Zener voltage of the desired Zener diode.

6. The power supply apparatus according to claim 4, wherein said control unit keeps ON said first switch even after said helix voltage is applied and turns ON or OFF said second switch so that a potential difference applied between said helix electrode and said anode electrode in normal operation of said electron tube becomes the Zener voltage of the desired Zener diode.

7. A high-frequency circuit system comprising the power supply apparatus according to claim 1 and a traveling-wave tube in which a predetermined DC voltage is supplied from said power supply apparatus to an anode electrode, a cathode electrode, a helix electrode and a collector electrode.

8. A high-frequency circuit system comprising the power supply apparatus according to claim 2 and a traveling-wave tube in which a predetermined DC voltage is supplied from said power supply apparatus to an anode electrode, a cathode electrode, a helix electrode and a collector electrode.

* * * * *

UNITED STATES PATENT AND TRADEMARK OFFICE

CERTIFICATE OF CORRECTION

PATENT NO. : 7,952,288 B2
APPLICATION NO. : 12/249572
DATED : May 31, 2011
INVENTOR(S) : Yukihira Nakazato It is certified that error appears in the above-identified patent and that said Letters Patent is hereby corrected as shown below:

On the Title Page, please delete the following,

Item "(73) Assignee: NEC Microwave Tube, Ltd., Kanagawa (JP)"

and please insert the following.

Item --(73) Assignee: NETCOMSEC CO. LTD, Tokyo (JP)--

Signed and Sealed this
Eighth Day of April, 2014

Michelle K. Lee

Michelle K. Lee
*Deputy Director of the United States Patent and Trademark Office*